US010161141B2

(12) United States Patent
Canfield et al.

(10) Patent No.: US 10,161,141 B2
(45) **Date of Patent: *Dec. 25, 2018**

(54) LOAD DISTRIBUTION STRUCTURES FOR RAISED FLOOR DATA CENTER

(71) Applicant: INTERNATIONAL BUSINESS MACHINES CORPORATION, Armonk, NY (US)

(72) Inventors: Shawn Canfield, Poughkeepsie, NY (US); John J. Loparco, Poughkeepsie, NY (US); Budy D. Notohardjono, Poughkeepsie, NY (US); John G. Torok, Poughkeepsie, NY (US)

(73) Assignee: INTERNATIONAL BUSINESS MACHINES CORPORATION, Armonk, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/832,913

(22) Filed: Dec. 6, 2017

(65) Prior Publication Data

US 2018/0320386 A1 Nov. 8, 2018

Related U.S. Application Data

(63) Continuation of application No. 15/587,701, filed on May 5, 2017.

(51) Int. Cl.

| | |
|---|---|
| ***E04F 15/024*** | (2006.01) |
| ***E04F 17/08*** | (2006.01) |
| ***E04B 5/43*** | (2006.01) |

(52) U.S. Cl.

CPC ..... *E04F 15/02458* (2013.01); *E04B 5/43* (2013.01); *E04F 15/02452* (2013.01); *E04F 17/08* (2013.01)

(58) Field of Classification Search

CPC ..... E04F 15/02458; E04F 15/02452; E04F 17/08; E04B 5/43

See application file for complete search history.

(56) References Cited

U.S. PATENT DOCUMENTS 2,956,652 A * 10/1960 Liskey, Jr. ..... E04F 15/02405 404/43
3,150,748 A * 9/1964 Liskey, Jr. ..... E04F 15/02405 52/396.04

(Continued)

OTHER PUBLICATIONS

Canfield et al., "Load Distribution Structures for Raised Floor Data Center", U.S. Appl. No. 15/587,701, filed May 5, 2017 (38 pages).

(Continued)

*Primary Examiner* — Rodney Mintz

(74) *Attorney, Agent, or Firm* — Tihon Poltavets, Esq.; Kevin P. Radigan, Esq.; Heslin Rothenberg Farley & Mesiti P.C.

(57) ABSTRACT

Load distribution structures are provided for a raised floor tile(s) of a raised floor data center. The load distribution structure, which resides adjacent to an opening in the raised floor tile(s), such as a cutout in the raised floor tile(s), to facilitate supporting a frame load, includes a frame load distributor and an edging bracket. The frame load distributor resides on the raised floor tile adjacent to the opening in the raised floor tile(s), and distributes, at least in part, the frame load on the raised floor tile(s). The edging bracket couples to the frame load distributor to, at least in part, hold the frame load distributor in fixed position on the raised floor tile(s). The edging bracket extends, at least in part, into the opening in the raised floor tile to secure the frame load distributor in fixed position relative to the opening in the raised floor tile(s).

11 Claims, 15 Drawing Sheets

(56) References Cited

U.S. PATENT DOCUMENTS

| | | | | |
|---|---|---|---|---|
| 3,180,460 | A * | 4/1965 | Liskey, Jr. | E04F 15/02405 52/126.6 |
| 5,392,571 | A | 2/1995 | Greenfield | |
| 5,440,841 | A | 8/1995 | Greenfield | |
| 5,467,609 | A | 11/1995 | Feeney | |
| 5,468,184 | A | 11/1995 | Collier | |
| 5,501,754 | A | 3/1996 | Hiraguri | |
| 5,787,663 | A | 8/1998 | Wehrmann | |
| 5,927,030 | A | 7/1999 | Petit et al. | |
| 6,134,850 | A | 10/2000 | Hui et al. | |
| 6,202,374 | B1 | 3/2001 | Cooper | |
| 6,550,195 | B1 | 4/2003 | Cooper | |
| 6,637,161 | B1 | 10/2003 | Buchalter | |
| 6,857,230 | B2 | 2/2005 | Owen | |
| 7,587,865 | B2 | 9/2009 | Moller, Jr. | |
| 7,665,250 | B2 | 2/2010 | Powell | |
| 7,779,587 | B1 | 8/2010 | Meyer | |
| 7,954,287 | B2 | 6/2011 | Bravo et al. | |
| 8,295,035 | B2 | 10/2012 | Collier | |
| 8,590,219 | B2 | 11/2013 | Meyer | |
| 8,683,762 | B2 | 4/2014 | Rodriquez et al. | |
| 9,038,324 | B2 | 5/2015 | Kugler et al. | |
| 9,394,700 | B1 | 7/2016 | Rodriguez | |
| 9,752,329 | B2 | 9/2017 | Rodriguez | |
| 9,790,690 | B2 | 10/2017 | Kugler | |
| 9,938,728 | B2 * | 4/2018 | Kugler | E04F 15/02183 |
| 2009/0056235 | A1 | 3/2009 | Morsching | |
| 2011/0102974 | A1 | 5/2011 | Collier | |
| 2013/0263539 | A1 | 10/2013 | Rodriquez et al. | |
| 2014/0237912 | A1 | 8/2014 | Kugler et al. | |
| 2015/0252574 | A1 | 9/2015 | Kugler et al. | |
| 2017/0009461 | A1 | 1/2017 | Rodriguez | |
| 2017/0138065 | A1 | 5/2017 | Kugler et al. | |
| 2017/0138066 | A1 | 5/2017 | Kugler et al. | |
| 2017/0260753 | A1 | 9/2017 | Kugler et al. | |
| 2017/0260754 | A1 | 9/2017 | Kugler et al. | |
| 2018/0202171 | A1 * | 7/2018 | Drewery | E04F 15/02405 |

OTHER PUBLICATIONS

Canfield et al., "List of IBM Patents and Patent Applications Treated as Related", U.S. Appl. No. 15/832,913, filed Dec. 6, 2017, dated Dec. 6, 2017 (2 pages).

* cited by examiner

LOAD DISTRIBUTION STRUCTURES FOR RAISED FLOOR DATA CENTER

BACKGROUND

In many server applications, processors, along with their associated electronics (e.g., memory, disc drives, power supplies, etc.), are packaged in a removable drawers or subsystems configuration stacked within an electronics rack or frame, including information technology (IT) equipment. In other cases, the electronics may be in fixed locations within the rack or frame.

As is known, as circuit density of electronic devices increases in order to achieve faster and faster processing speeds, there is a corresponding demand for circuit devices to be packed more closely together, and for circuits themselves to be operated at increasingly higher clock speeds. Each new generation of processors and associated electronics continues to offer increased speed and function. In most cases, this is been accomplished by a combination of increased power dissipation and increased packaging density. The net result has been increased circuit density at all levels of packaging, including at the electronics rack level. This increased packaging density continues to increase load at the electronics rack level on the data center floor, which may be of concern in a raised floor data center environment.

SUMMARY

The shortcomings of the prior art are overcome and additional advantages are provided through the provision, in one or more aspects, of an apparatus which includes a load distribution structure for a floor tile to facilitate distributing a frame load on the floor tile. The load distribution structure includes a frame load distributor to reside on the floor tile adjacent to an opening in the floor tile, and an edging bracket coupled to the frame load distributor. The frame load distributor distributes, at least in part, the frame load on the floor tile, and the edging bracket is coupled to the frame load distributor to, at least in part, hold the frame load distributor in fixed position on the floor tile. The edging bracket extends, at least in part, into the opening in the floor tile to in part secure the frame load distributor in fixed position relative to the opening in the floor tile.

In another aspect, a data center is provided which includes a floor structure including multiple floor tiles. A floor tile of the multiple floor tiles includes an opening for passing conduit through the floor tile. The data center further includes a frame disposed on the floor structure, including on the floor tile having the opening, and a load distribution structure disposed on the floor tile to facilitate distributing the frame's load on the floor tile. The load distribution structure includes a frame load distributor and an edging bracket. The frame load distributor is disposed on the floor tile adjacent to the opening, and distributes, at least in part, load of the frame on the floor tile. The edging bracket is coupled to the frame load distributor to, in part, hold the frame load distributor in fixed position on the floor tile. The edging bracket extends, at least in part, into the opening of the floor tile to in part secure the frame load distributor in fixed position relative to the opening of the floor tile.

In a further aspect, a method of facilitating supporting a frame on a floor structure of a data center is provided. The method includes providing a load distribution structure for a floor tile of the floor structure. The load distribution structure facilitates supporting a frame load on the floor tile. The providing of the load distribution structure includes providing a frame load distributor to reside on the floor tile adjacent to an opening of the floor tile. The frame load distributor distributes, at least in part, the frame load on the floor tile. Providing the load distribution structure further includes providing an edging bracket coupled to the frame load distributor to, at least in part, hold the frame load distributor in fixed positon on the floor tile. The edging bracket extends, at least in part, into the opening in the floor tile to in part secure the frame load distributor in fixed position relative to the opening in the floor tile.

Additional features and advantages are realized through the techniques of the present invention. Other embodiments and aspects of the invention are described in detail herein and are considered a part of the claimed invention.

BRIEF DESCRIPTION OF THE DRAWINGS

One or more aspects of the present invention are particularly pointed out and distinctly claimed as examples in the claims at the conclusion of the specification. The foregoing and other objects, features, and advantages of the invention are apparent from the following detailed description taken in conjunction with the accompanying drawings in which:

DETAILED DESCRIPTION

Aspects of the present invention and certain features, advantages and details thereof, are explained more fully below with reference to the non-limiting example(s) illustrated in the accompanying drawings. Descriptions of well-known materials, systems, devices, processing techniques, etc., are omitted so as to not unnecessarily obscure the invention in detail. It should be understood, however, that the detailed description and the specific example(s), while indicating aspects of the invention, are given by way of illustration only, and are not by way of limitation. Various substitutions, modifications, additions, and/or arrangements, within the spirit and/or scope of the underlying inventive concepts will be apparent to those skilled in the art from this disclosure. Note further that numerous inventive aspects and features are disclosed herein, and unless inconsistent, each disclosed aspect or feature is combinable with any other disclosed aspect or feature as desired for a particular application, for instance, for providing a load distribution structure for a raised floor tile of a raised floor data center.

Note that, the term frame includes an electronics rack or frame, as well as a computer room air-handler (CRAH) frame. In one or more embodiments, the frame may have casters to allow for movement of the frame on a data center floor, and in one or more embodiments, leveling feet to facilitate leveling of the frame on the data center floor once properly positioned. Further, terms electronics rack and rack are used interchangeably herein, and may include (for instance) any housing, compartment, server system, etc., having one or more heat generating components of a computer system, electronic system, or information technology (IT) system. In one embodiment, an electronics rack may include one or more electronic systems or subsystems. An electronic system or subsystem of an electronics rack may be movable or fixed relative to the electronics rack, with the electronics drawers of a multi-drawer rack unit and blades of a blade center system being two examples of systems or subsystems of an electronics rack. Further, a data center is, or includes, a computer or information technology (IT) installation containing one or more electronic systems, electronics racks, etc. As a specific example, a data center may include one or more rows of rack-mounted computing units, such as rack mounted server units.

Note also that reference is made below to the drawings, where the same reference numbers used throughout different figures designate the same or similar components.

Figure 1:
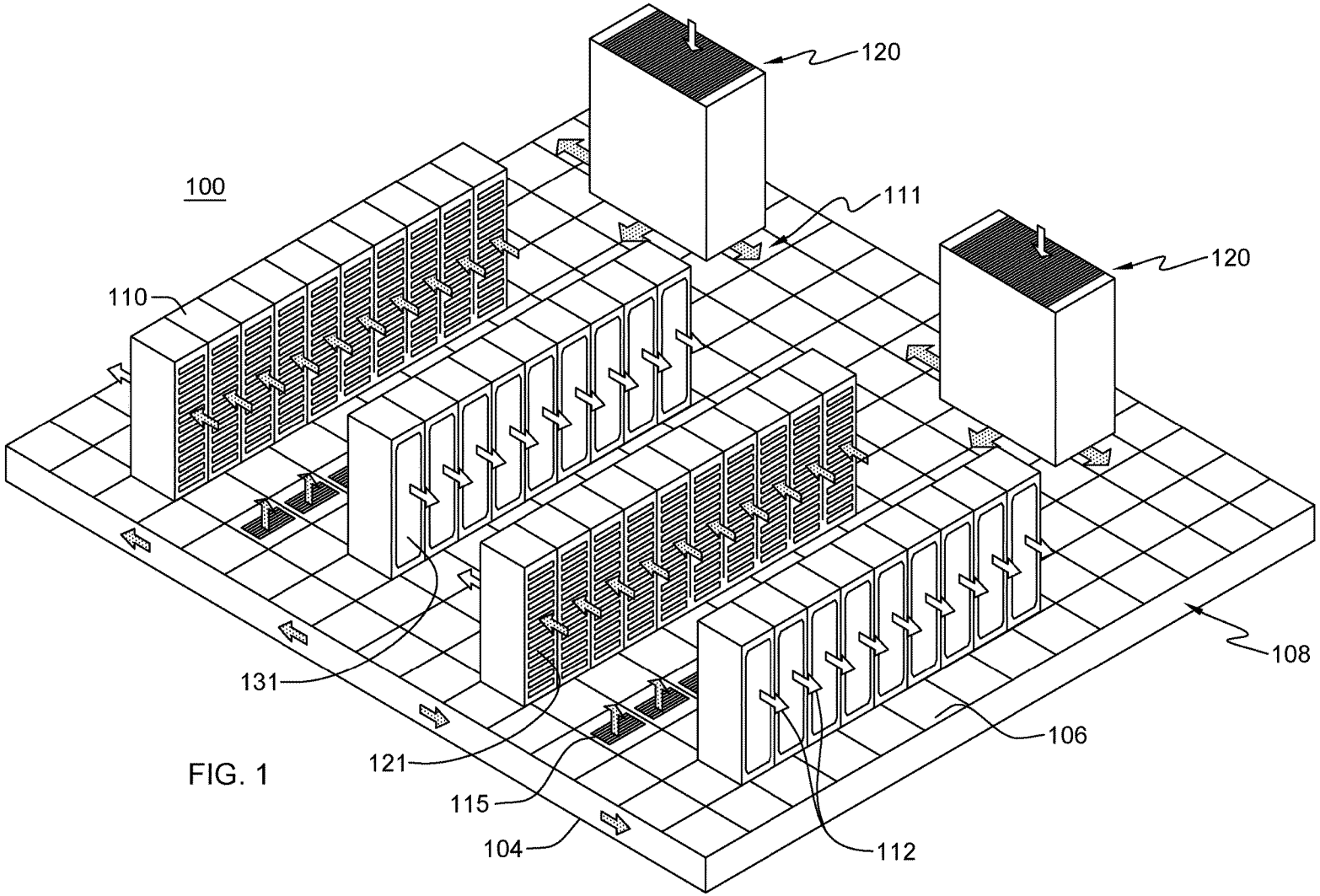
FIG. 1 depicts one embodiment of a raised floor data center within which one or more load distribution structures may be used, in accordance with one or more aspects of the present invention.

FIG. 1 depicts one embodiment of a data center 100, which in one example, is a raised floor layout of a computer installation or data center 100. Data center 100 includes electronics (or information technology (IT)) racks 110 disposed in one or more rows on a raised floor structure 106 of data center 100. One or more computer room air-handling units (CRAHs) 120 (also referred to as computer room air-conditioners (CRACs)) take in hot air, for example, through one or more air inlet vents in the top of the CRAHs, and exhaust cold air into a sub-floor plenum 108 below raised floor structure 106. Hot airflow within data center 100 is depicted by light arrows 112, and cold airflow within data center 100 is indicated by stippled arrows 111.

As shown in FIG. 1, electronics racks 110 may employ (in one example) a front-to-back cooling approach. Namely, according to this approach, cold air 111 is drawn in through a front or air-inlet side 121 of each rack, and hot air 112 is exhausted from a back or air-outlet side 131 of each rack. The cold air drawn into the front of the rack is supplied to air inlets of the electronic components (e.g., servers) disposed within the racks. Space between raised floor structure 106 and a sub-floor 104 defines the sub-floor plenum 108. Sub-floor plenum 108 may serve, in part, as a conduit to transport, for example, cold air 111 from the air-handling unit(s) 120 to the electronics racks 110. In one embodiment, electronics racks 110 are arranged in a hot aisle/cold aisle configuration, with their air-inlet sides and air-outlet sides disposed in alternating directions, as illustrated in FIG. 1. Cold air 111 may be provided through one or more perforated floor tiles 115 in raised floor structure 106 from sub-floor plenum 108 into the cold aisles of the data center. The cold air 111 is then drawn into electronics racks 110, via their inlets, and subsequently exhausted into the data center as hot air via outlets of the individual electronics racks into the hot aisles of the data center.

As explained further herein, the sub-floor plenum of 108 below raised floor structure 106 also may accommodate conduit or cabling for the raised floor data center which may, in part, provide signals and power into and out of electronics racks 110 of data center 100, as well as interconnect one or more electronics racks 110 in certain implementations.

As noted, the term frame may include an electronics rack frame, or a computer room air-handling unit (CRAH) frame. Electronics racks 110 and CRAHs 120 of FIG. 1 are examples of a frame which imposes a frame load on a raised floor structure of a raised floor data center.

Figure 2:
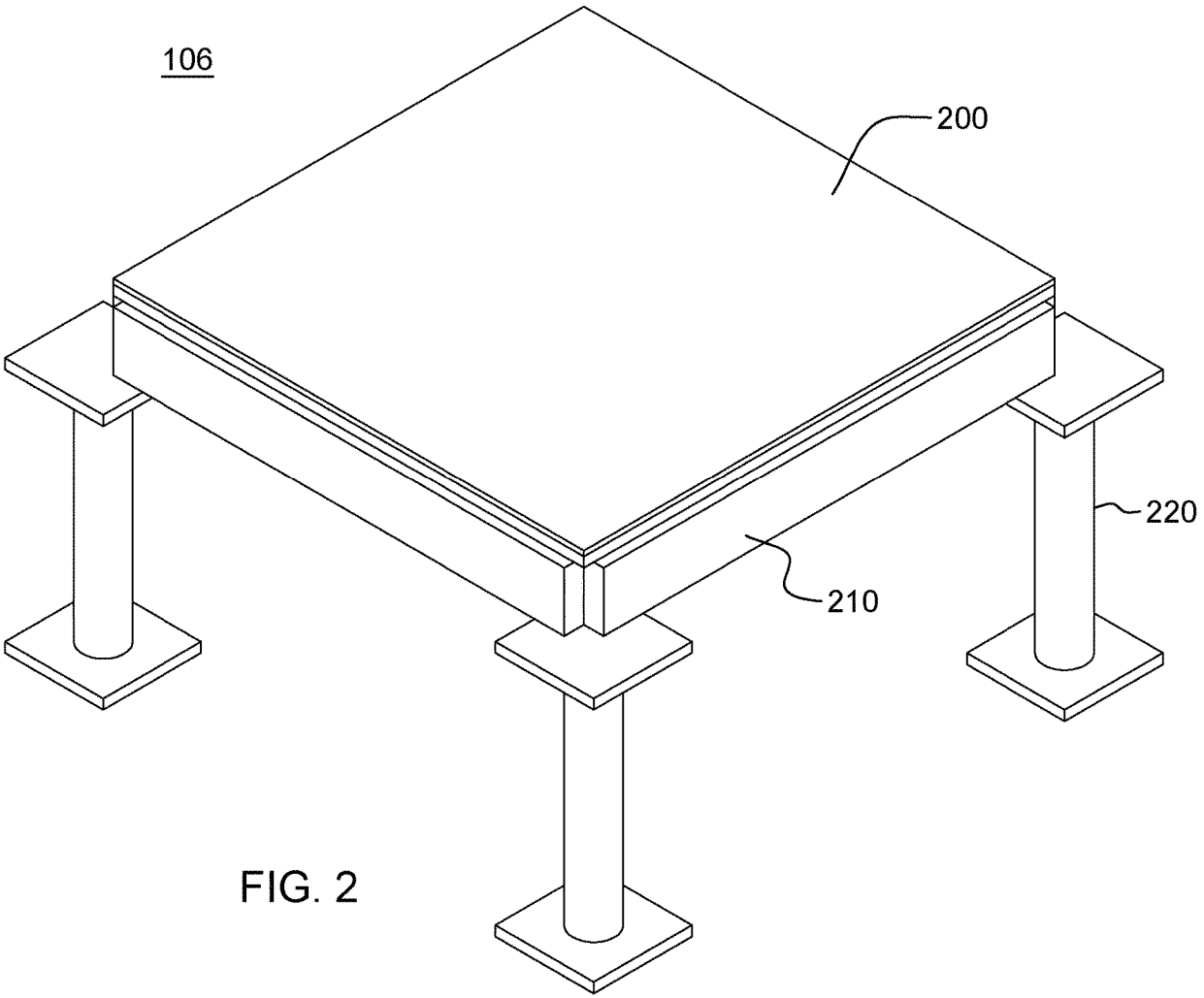
FIG. 2 is an isometric view of a partial embodiment of a raised floor structure with which a load distribution structure may be used, in accordance with one or more aspects of the present invention.

By way of further example, FIG. 2 depicts a partial embodiment of a raised floor structure 106 for a raised floor data center. The raised floor structure of the data center may include any desired number of raised floor tiles 200, which may include solid or perforated covers. By way of example, raised floor structure 106 may also include (in this embodiment) a series of support bars 210 disposed on underfloor stanchions 220. Raised floor structures 106, including raised floor tiles 200, are typically removable, and can be replaced within the data center, as well as cut to define cable openings to the sub-floor plenum.

Figure 3A:
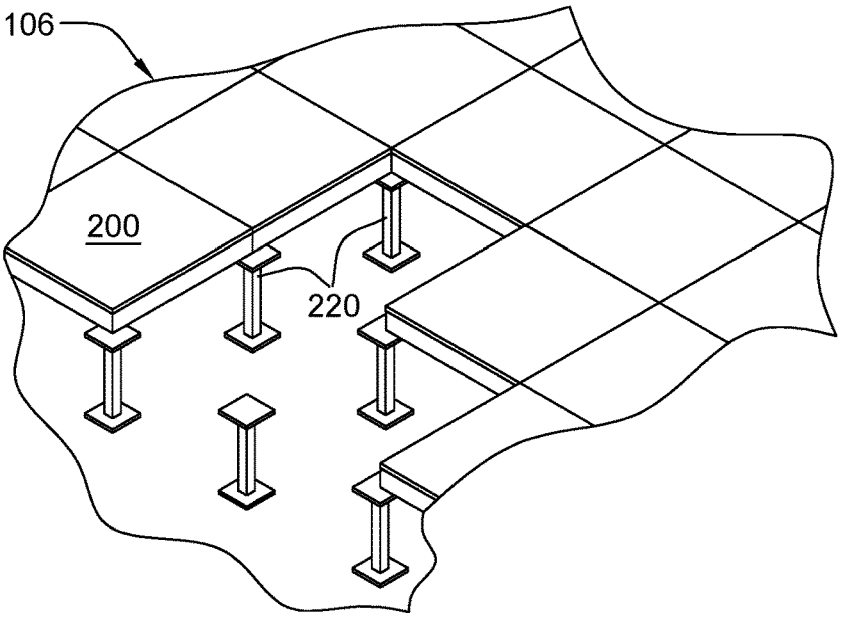
FIGS. 3A & 3B depict partial alternate embodiments of a raised floor structure of a raised floor data center, with which one or more load distribution structures may be used, in accordance with one or more aspects of the present invention.
Figure 3B:
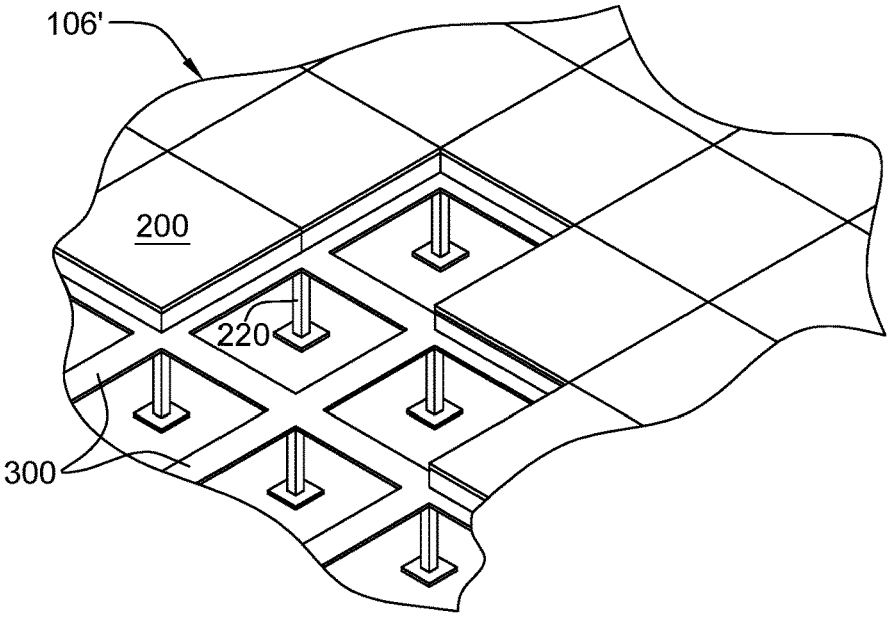

By way of further example, FIG. 3A partially depicts a more detailed illustration of one embodiment of an assembled raised floor structure 106 of a data center. In this example, raised floor structure 106 again employs, for instance, raised floor tiles 200 of FIG. 2 on underfloor stanchions 220. FIG. 3B depicts another embodiment of a partially assembled raised floor structure 106' of a data center. In this embodiment, raised floor structure 106' includes underfloor stanchions 220 and stringers 300 supporting raised floor tiles 200.

Figure 4:
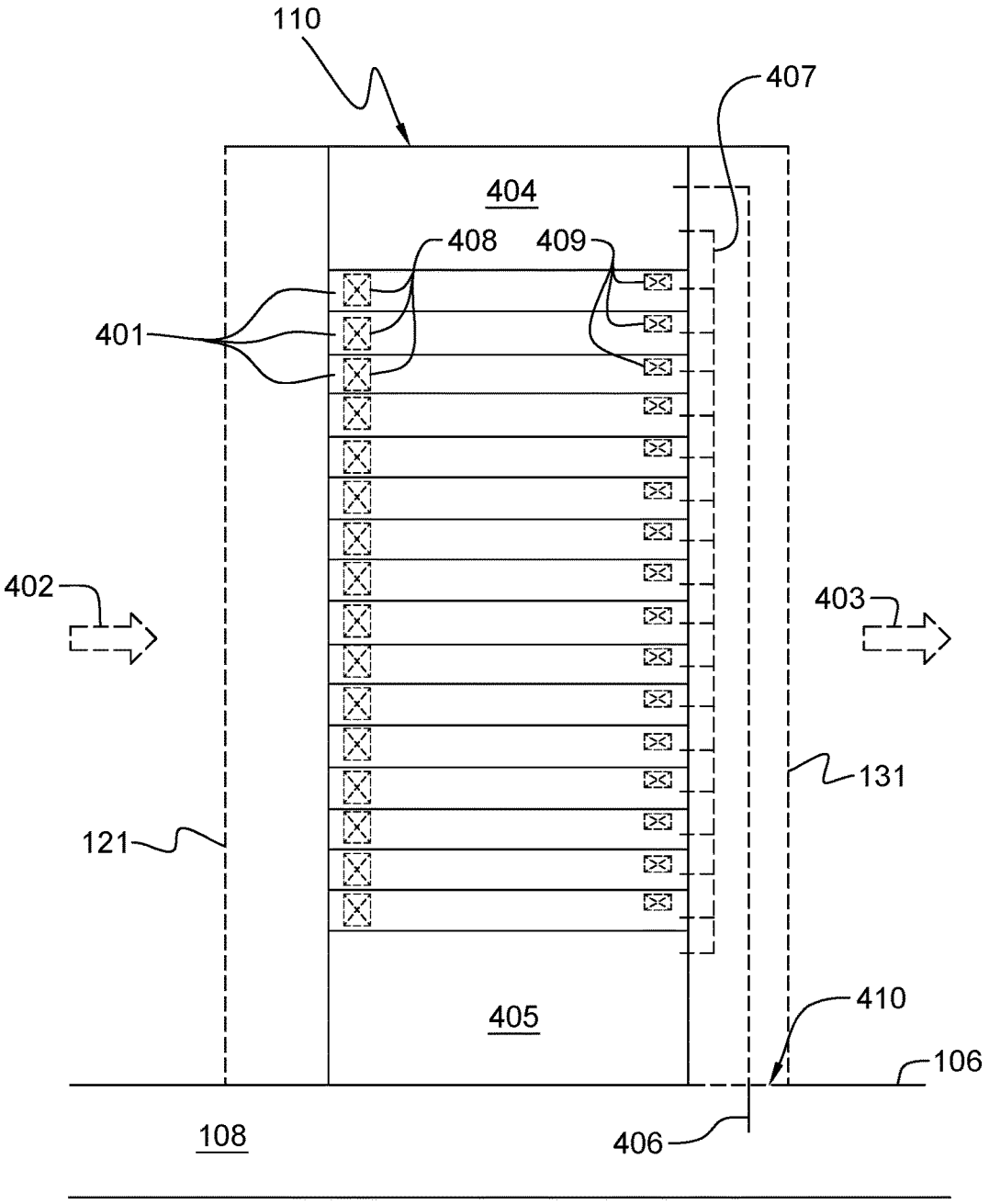
FIG. 4 is a cross-sectional elevational view of one embodiment of an electronics rack of the raised floor data center of FIG. 1, and illustrating a cutout or opening in a raised floor tile, in association with which one or more load distribution structures (not shown) may be used, in accordance with one or more aspects of the present invention.

By way of further example, FIG. 4 depicts one embodiment of an electronics rack 110 with a plurality of electronic subsystems 401. In the embodiment illustrated, electronic subsystems 401 may be air-cooled by cold airflow 402 ingressing via air inlet side 121, and exhausting out air outlet side 131 as hot airflow 403. By way of example, one or more axial fan assemblies 408 may be provided at the air inlet sides of electronic subsystems 401 and/or one or more centrifugal fan assemblies 409 may be provided at the air outlet sides of electronic subsystems 401 to facilitate airflow through the individual subsystems 401 as part of cooling electronics rack 110. One or more of electronic subsystems 401 may further include, for instance, components of a computer system, electronics system, and/or information technology (IT) equipment. For example, one or more of the electronic subsystems 401 may include one or more processors and associated memory.

Electronics rack 110 may also include, by way of example, one or more bulk power assemblies 404 of an AC to DC power supply assembly. AC to DC power supply assembly may further includes, in one embodiment, a frame controller, which may be resident in the bulk power assembly 404 and/or in one or more electronic subsystems 401. Also illustrated in FIG. 4 is one or more input/output (I/O) drawer(s) 405, which may also include a switch network. I/O drawer(s) 405 may include, as one example, PCI slots and disk driver for the electronics rack.

In the depicted implementation, a three-phase AC source may feed power via an AC power supply line cord 406 to bulk power assembly 404, which transforms the supplied AC power to an appropriate DC power level for output via distribution cable 407 to the plurality of electronic subsystems 401 and I/O drawer(s) 405. The number of electronic subsystems installed in the electronics rack is variable, and depends on customer requirements for a particular system. Further, axial or centrifugal fan assemblies could alternatively, or also, reside within, for instance, bulk power assembly 404, or I/O drawer(s) 405. Again, the particular electronics rack 110 configuration of FIG. 4 is presented by way of example only, and not by way of limitation.

As illustrated in the embodiment of FIG. 4, electronics rack 110 may reside on a raised floor structure 106 of a raised floor data center. In implementation, an opening 410, such as a cutout, may be provided in one or more raised floor tiles adjacent to or under electronics rack 110. In the example illustrated, opening 410 is provided in raised floor structure 106 to allow for conduit of electronics rack 110, including AC power supply line cord 406, to pass into sub-floor plenum 108.

Figure 5:
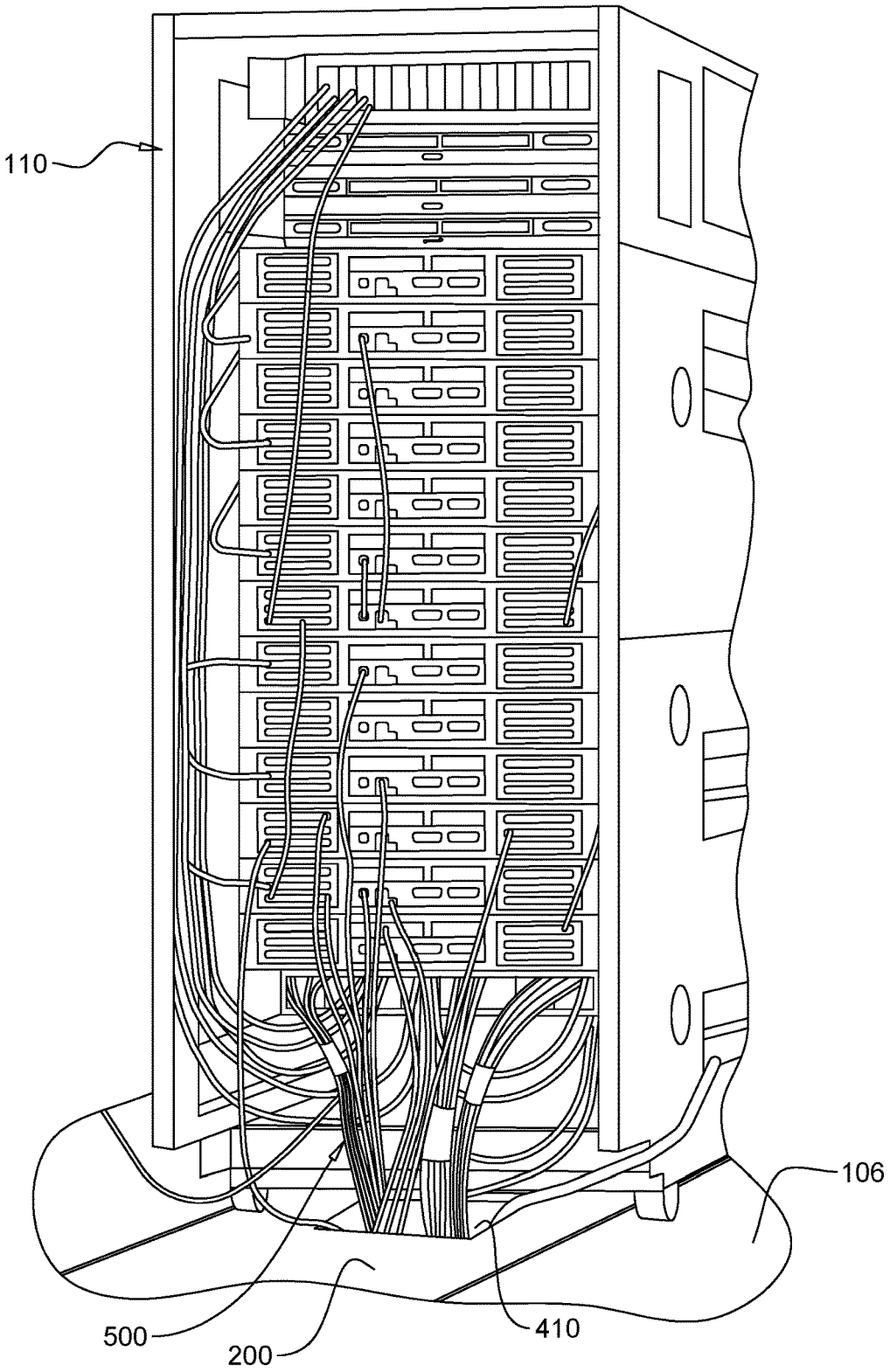
FIG. 5 depicts a further embodiment of an electronics rack disposed on a raised floor structure of a raised floor data center with a cutout in a raised floor tile to facilitate passing of conduit beneath the raised floor structure, and which one or more load distribution structures may be used, in accordance with one or more aspects of the present invention.

FIG. 5 depicts one embodiment of the extent of conduit in greater detail. As illustrated in FIG. 5, electronics rack 110 resides on raised floor structure 106, which includes a cutout 410 in a raised floor tile 200 to allow conduit 500 to pass from or to the sub-floor plenum beneath raised floor structure 106. In this example, cutout or opening 410 is shown disposed at the back of the electronics rack 110, by way of example only. As noted, conduit 500 may include power and communication lines for electronics rack 110, as well as facilitate coupling, for instance, the electronics rack to one or more other electronics racks or other electronic equipment within the data center.

As noted initially, electronic package density continues to increase at all levels, including at the electronics rack level, which continues to increase electronic rack loading on the raised floor structure of the raised floor data center. Additionally, along with increased electronic packaged density at the rack level, the size of an electronics rack continues to shrink. In future generations, it is assumed that an electronics rack may only occupy the footprint of two conventional raised floor tiles of a raised floor data center, rather than being dispersed across four raised floor tiles as in most current implementations.

Raised floor tile manufacturers typically publish ratings for their raised floor tiles or panels. For instance, a raised center floor tile may be rated as capable of supporting a static point load equal to 1,000 or 1,250 pounds. This rating assumes that the raised floor tile is uncut, and does not apply for a raised floor tile which has been cut to enable cable egress below the raised floor structure. Currently, there are no published load limits for raised floor tiles with cuts to allow for cable egress.

With ever increasing load at the electronics rack level on the data center floor, and particularly on a raised floor structure, further structural support enhancements are desired. By way of example, it is anticipated that electronics racks may soon weigh more than 2,500 pounds, with the entire frame load resting on, for instance, four casters and/or leveling feet. In such configurations, the maximum point load for any given leveling foot may be one third of the total weight of the rack. With future electronics rack occupying, for instance, a single 600 mm floor tile width, and two (600 mm) floor tiles in depth, two leveling feet may be resting on the same raised floor tile, which may also have an opening or cutout to allow for cable egress. Embodiments of this are depicted by way of example, in FIGS. 6A-6C.

Figure 6A:
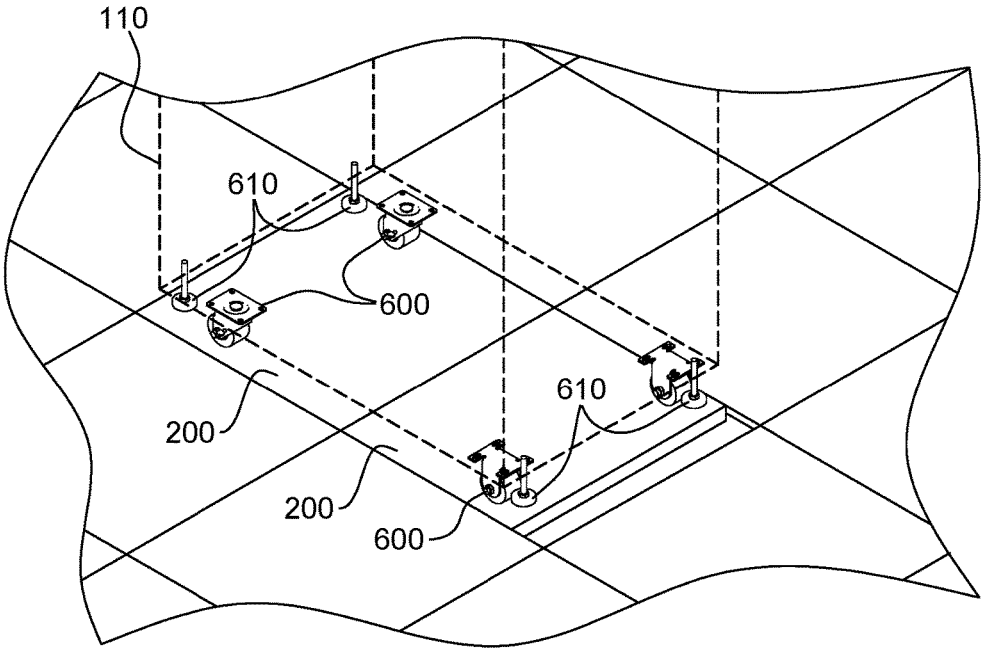
FIGS. 6A-6D depict different tile loading positions of a frame, such as an electronics rack, and various alternate configurations of tile cutouts for conduit, where frame loading may occur within the confines of two (or four) raised floor tiles of the raised floor structure, and with which a load distribution structure may be used, in accordance with one or more aspects of the present invention.
Figure 6B:
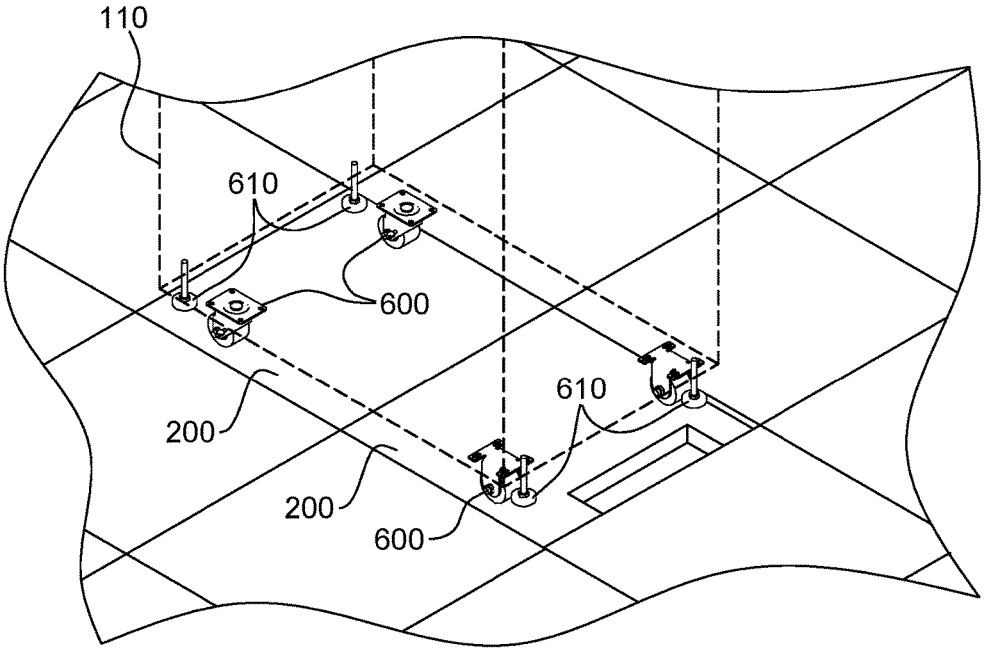
Figure 6C:
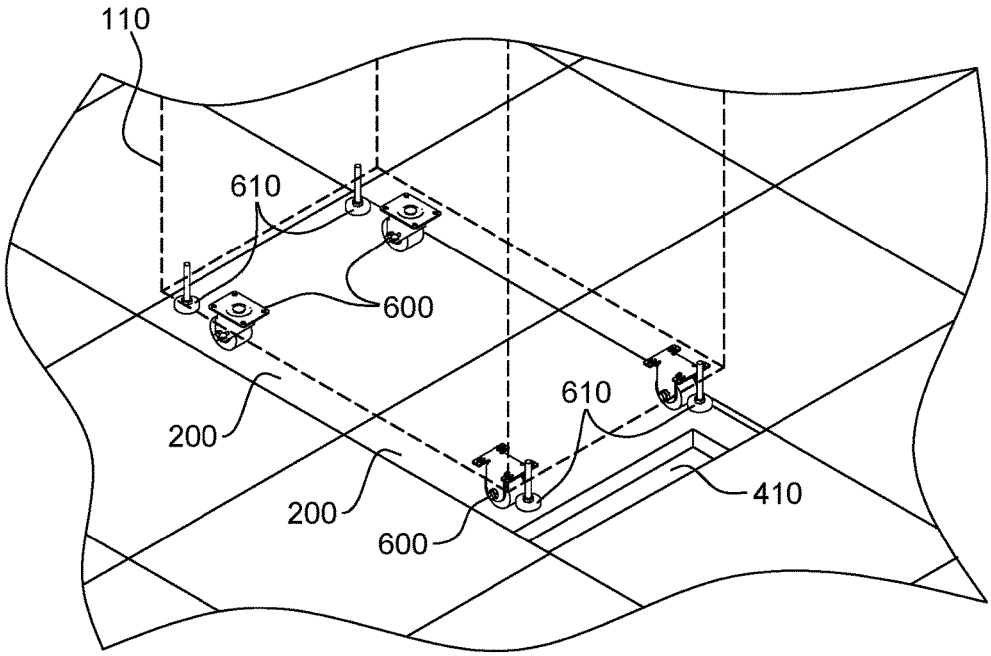

As shown, in one or more implementations, a frame, such as electronics rack 110, may include swivel casters 600 on the underside which facilitate moving the electronics rack within the data center, as desired. Once the rack is at the desired location, leveling feet 610 may be used to level the electronics rack, which also sets the rack in fixed position by removing the weight of the electronics rack from casters 600. In the examples of FIGS. 6A-6C, the leveling feet 610 are shown by way of example within the width of two raised floor tiles 200, one of which has an opening 410, for instance, to allow for the passage of conduit through the raised floor structure. Opening 410 in raised floor tile 200 is shown differently configured and positioned in FIGS. 6A-6C, by way of example. As shown, opening 410 may be formed as a full width tile cutout or a partial width tile cutout, as desired.

Figure 6D:
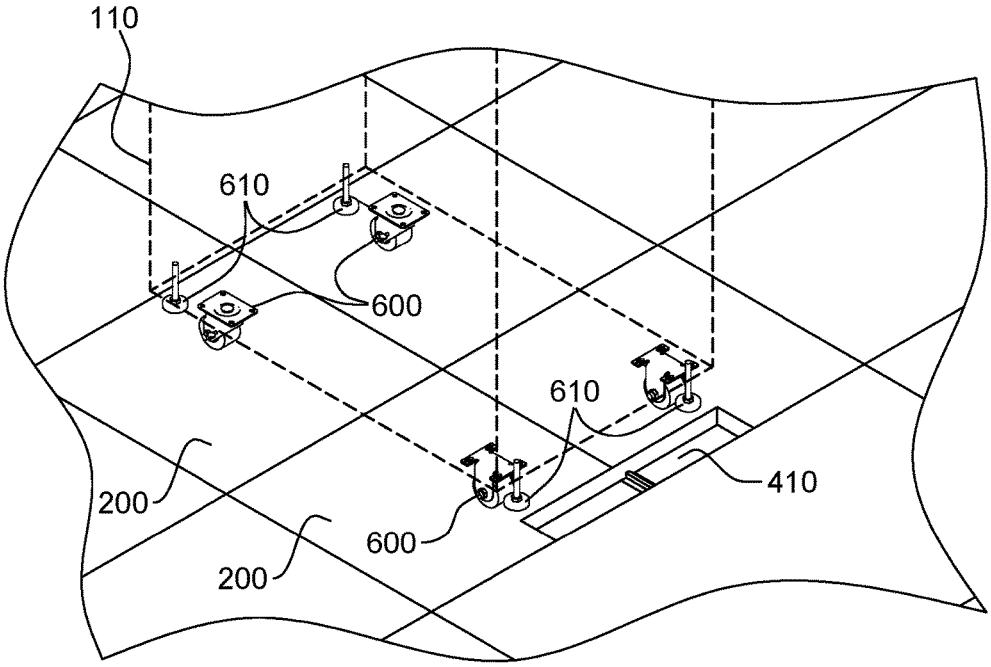

FIG. 6D illustrates an embodiment where the frame, such as electronics rack 110, is sized and positioned to span four adjacent raised floor tiles 200, with opening 410 being a multi-tile cutout spanning two adjacent floor tiles. In this example, the static load of the leveling feet 610 is distributed across four raised floor tiles 200, however, the two raised floor tiles with opening 410 have static loads adjacent to the cutout which may be approaching the capability of the tile to handle the load.

Based on anticipated future loadings on the raised floor structure, and in particular, on raised floor tiles with cutouts, it is believed that excessively high static point loads associated with floor tiles with cutouts may require added support, such as added under the floor support. If added under floor support is employed, it may further complicate configuration or re-configuration of the data center. For instance, such an approach may require an installation plan, and could potentially be disruptive to turnaround time for push/pull installations requiring less than 8 hours. By way of example, the added support would need to be positioned and aligned directly or close to directly under where the leveling feet are to fall in a particular installation.

Note also that there is a further need to have barrier edging at a cutout to prevent the frame casters from rolling into the opening, potentially causing the frame to tip over. As a further consideration, floor tile edge protection may be desired to protect against damage to conduit or cabling egressing from under the raised floor structure through the cutout.

Generally stated, disclosed herein are an apparatus, raised floor data center and method of fabrication which facilitate supporting a frame, such as an electronics rack or a CRAH unit, on a raised floor structure. The apparatus includes, for instance, a load distribution structure for a raised floor tile to facilitate distributing a frame load on the raised floor tile. The load distribution structure includes a frame load distributor to reside on the raised floor tile adjacent to an opening in the raised floor tile, and distribute, at least in part, the frame load on the raised floor tile. Further, the load distribution structure includes an edging bracket coupled to the frame load distributor to, at least in part, hold the frame load distributor in fixed position on the raised floor tile. The bracket extends, at least in part, into the opening in the raised floor tile to (in one aspect) secure the frame load distributor in fixed position relative to the opening in the raised floor tile.

In one or more implementations, the opening in the raised floor tile is a cutout in the raised floor tile, and the edging bracket further extends into the cutout, covering an upper edge of the raised floor tile to protect conduit, such as cabling or hoses, passing through the cutout. In one or more embodiments, the edging bracket further wraps over the frame load distributor and holds the frame load distributor on the raised floor tile at a set, spaced distance from an edge of the cutout in the raised floor tile. Further, in one or more implementations, the edging bracket may extend into the cutout and include a lower flange extending around a lower edge of the raised floor tile at the cutout, and overlying and engaging, at least in part, a lower surface of the raised floor tile. The lower flange engaging the lower surface of the raised floor tile assists the load distribution structure in providing further structural support for the raised floor tile.

In one or more embodiments, the edging bracket may be a single-piece edging bracket configured for the cutout in the raised floor tile, and the edging bracket may extend a length of the cutout of the raised floor tile. In one or more other embodiments, the edging bracket may include a bracket assembly having multiple pre-configured bracket sections disposed, at least in part, side by side, and secured to the frame load distributor by multiple fasteners. Further, the frame load distributor may include multiple interlocking bar sections, and the multiple fasteners may further facilitate securing together the multiple interlocking bar sections of the frame load distributor. In one or more implementations, the multiple interlocking bar sections may include at least one z-shaped interlocking bar section.

More particularly, load distribution structures and methods of fabrication are advantageously disclosed herein which employ either multi-piece or single-piece, rack load distributors, and multi-piece or single-piece edging brackets. The load distribution structure and method provide, in part, point load support by distributing point loading across a raised floor tile to improve structural integrity of a cut raised floor tile with minimum deflection of the floor tile. Safety is also enhanced by providing a berm to protect against the casters of the frame (e.g., electronics rack or CRAH unit) rolling into the cutout in the raised floor tile, and thereby preventing the rack from tipping over should one or more casters go down into the cutout in the floor tile. This facilitates rolling the frame on the raised floor structure during installation to position the frame in its final location. Edging brackets with rounded edges are also provided to prevent conduit damage by protecting the conduit against contact with cut raised floor tile edges. Further, in the multiple piece designs, the load distribution structure is modular. For instance, with either four inch or 100 mm wide multi-piece edging brackets and interlocking bar sections, configuration of the load distribution structure may be optimized for a particular cutout configuration, allowing for flexibility of installation and customization for both 24 inch wide and 600 mm wide raised floor tiles, respectively.

Figure 7A:
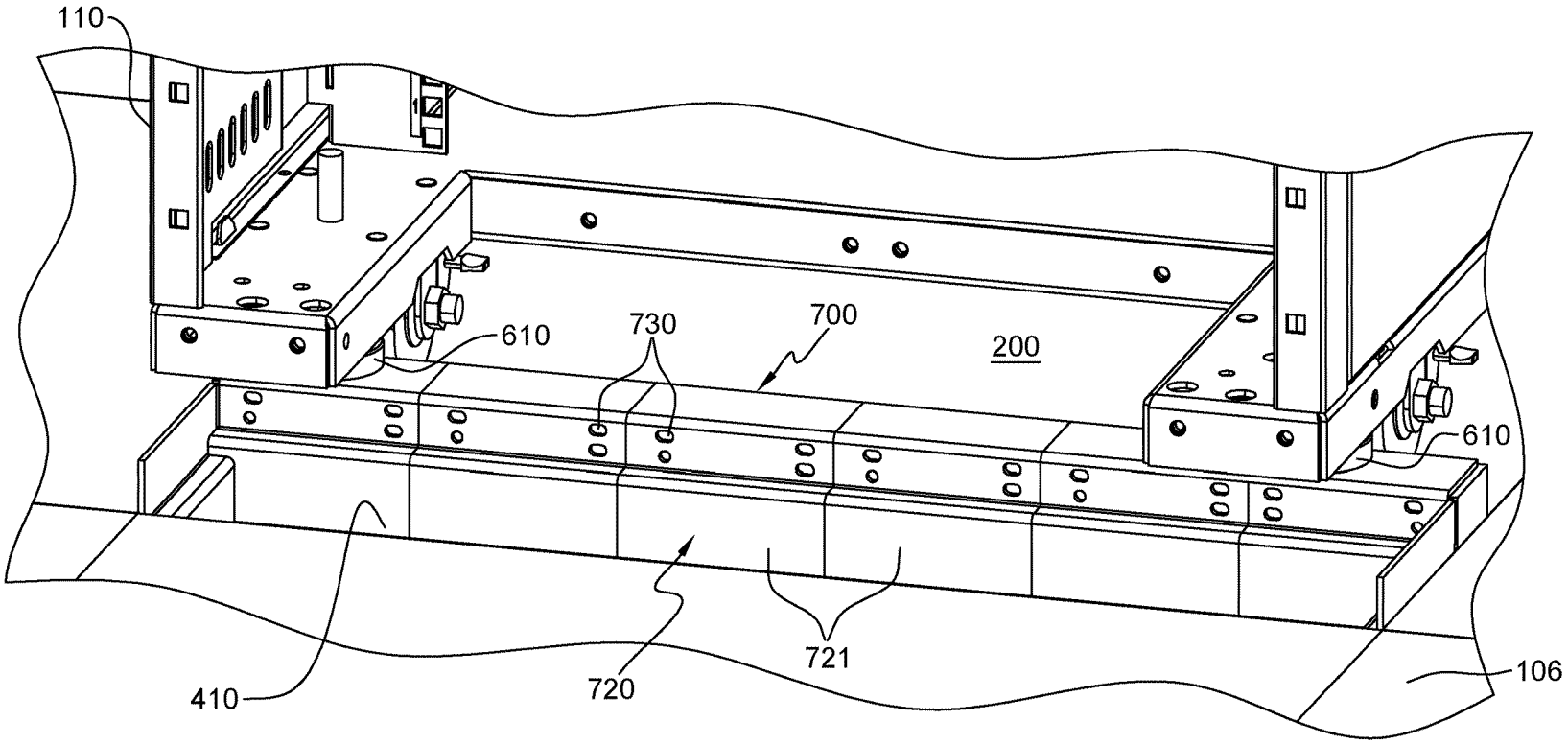
FIG. 7A depicts a partial embodiment of a raised floor data center showing one embodiment of a load distribution structure in operation supporting, at least in part, a frame load on a raised floor tile with a cutout, in accordance with one or more aspects of the present invention.
Figure 7B:
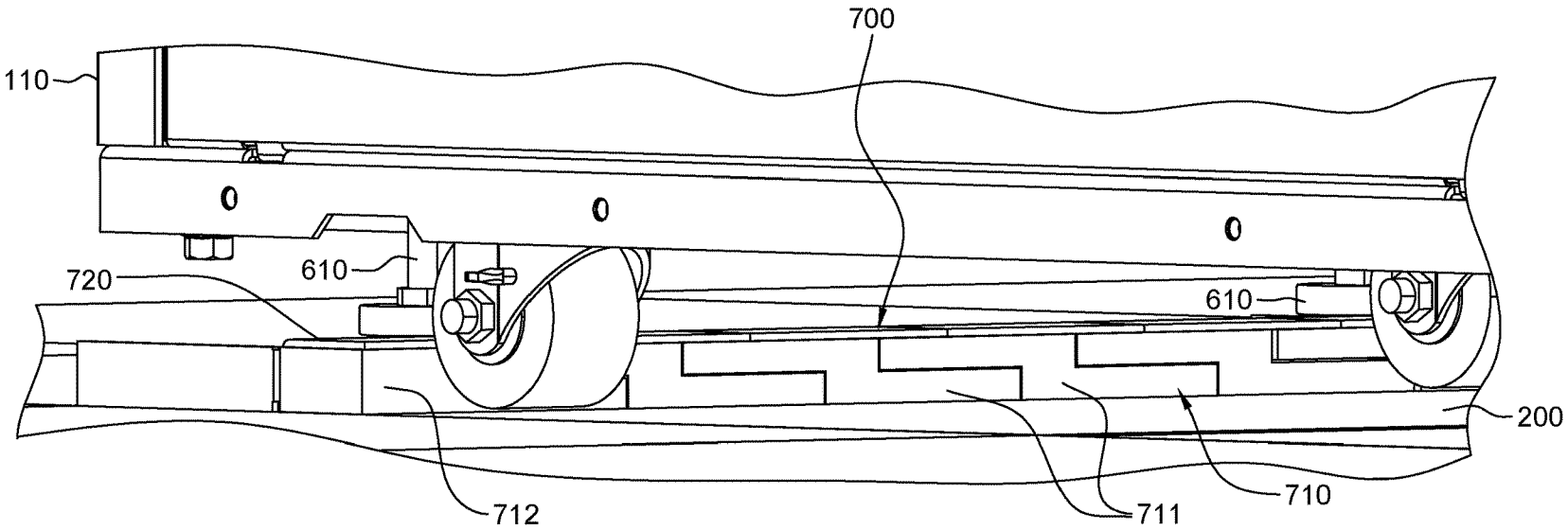
FIG. 7B is a back view of the load distribution structure of FIG. 7A, in accordance with one or more aspects of the present invention.
Figure 7C:
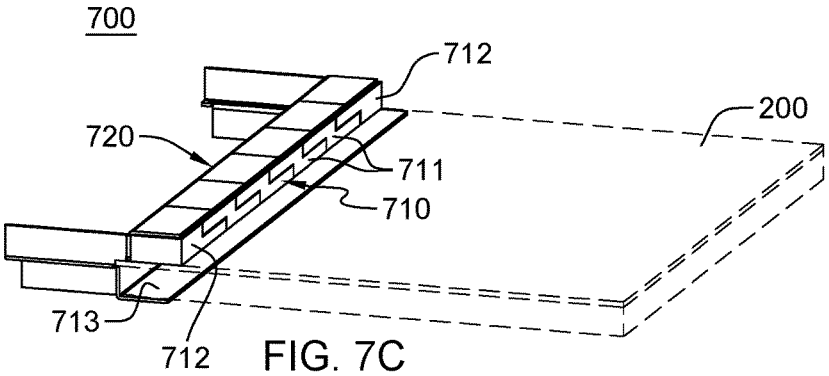
FIG. 7C depicts the load distribution structure of FIGS. 7A & 7B, with the raised floor tile (shown dashed) having a cutout for (for instance) the passage of conduit, in accordance with one or more aspects of the present invention.
Figure 7D:
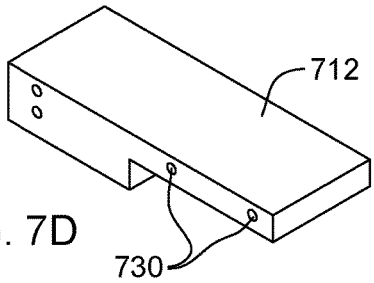
FIG. 7D depicts one interlocking bar section of the multiple interlocking bar sections of the load distribution structure embodiment of FIGS. 7A-7C, in accordance with one or more aspects of the present invention.
Figure 7E:
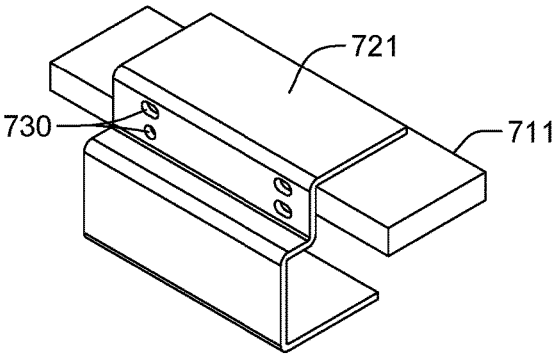
FIG. 7E depicts another interlocking bar section of the multiple interlocking bar sections of the load distribution structure embodiment of FIGS. 7A-7C, shown in combination with one bracket section of multiple bracket sections of an edging bracket of the load distribution structure embodiment, in accordance with one or more aspects of the present invention.
Figure 7F:
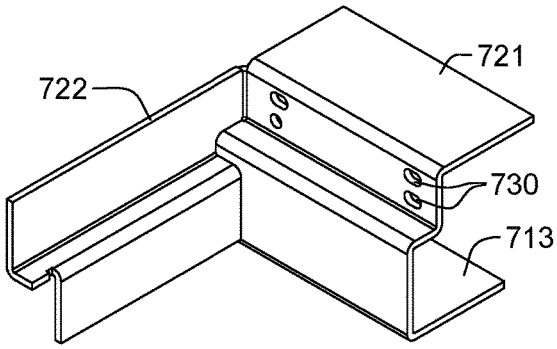
FIG. 7F depicts another bracket section of the edging bracket of the load distribution structure embodiment of FIGS. 7A-7C, in accordance with one or more aspects of the present invention.

FIGS. 7A-7F depict one embodiment of a load distribution structure 700, in accordance with one or more aspects of the present invention. Referring initially to FIGS. 7A-7C, load distribution structure 700 is shown disposed at or adjacent to an opening 410 (or cutout) in a raised floor tile 200 of a raised floor structure 106 of a raised floor data center. A frame, such as an electronics rack 110, is shown in FIGS. 7A & 7B with casters 600 and leveling feet 610. As shown in these figures, electronics rack 110 is sized such that two leveling feet 610 fall within the width of raised floor tile 200 at or adjacent to opening 410 in raised floor tile 200, which may be present to facilitate passage of conduit from the sub-floor plenum to electronics rack 110.

In the embodiment illustrated, load distribution structure 700 includes a frame load distributor 710 and an edging bracket 720. In this example, both frame load distributor 710 and edging bracket are multi-piece structures. In particular, frame load distributor 710 is shown to include multiple interlocking bar sections 711, 712, and edging bracket 720 is shown to include multiple preconfigured bracket sections 721, 722. In this example, edging bracket 720 extends into edging 410 in raised floor tile 200 and covers an upper edge of the raised floor tile at the cutout (i.e., opening 410) to protect conduit or cabling passing through the cutout. Further, the frame load distributor 410 is set back slightly from the edge of the cutout such that the edging bracket includes a step where wrapping around the cutout in the raised floor tile. Additionally, in this embodiment, edging bracket 720 includes an upper flange which wraps over the top of frame load distributor 710, again including rounded edges where conduit, such as cabling or hoses, will pass between electronics rack 110 and opening 410 and raised floor tile 200. Additionally, edging bracket 720 includes a lower flange 713 (FIG. 7C) which wraps around a lower edge of the raised floor tile at the cutout, and overlies and contacts, at least in part, a lower surface of the raised floor tile. Lower flange 713 engaging the lower surface of the raised floor tile facilitates the load distribution structure 700 in providing further structural support to the raised floor tile.

FIGS. 7C-7F depict further details of the load distribution structure 700 of FIGS. 7A & 7B. As noted, in one or more implementations, load distribution structure 700 includes edge bracket 720 which wraps over a portion of an upper surface of raised floor tile 200, including over frame load distributor 710, and wraps around a lower edge of raised floor tile 200 at opening 410, overlying a portion of the lower surface of the raised floor tile. As depicted in FIG. 7C, frame load distributor 710 further includes, in one or more embodiments, multiple interlocking bar sections, including, for instance, multiple z-shaped interlocking bar sections 711 and respective end interlocking bar sections 712. Those skilled in the art will understand that with such a configuration the length of frame load distributor 710 may be readily adjusted for different sized cutouts or openings in the raised floor tile. For instance, the frame load distributor may be shortened by removing one or more z-shaped interlocking bar sections 711 or lengthened by adding one or more z-shaped interlocking bar sections 711. Fastener opening 730 may be provided extending through edging bracket 720 and into the multiple interlocking bar sections 711, 712, as shown, for instance, in FIGS. 7D-7F. With respect to FIG. 7F, one embodiment of an edge or side bracket 722 is also depicted. This edge bracket and adjacent bracket section 721 define a corner bracket, which could be a unitary structure, or could include two pieces. In one or more embodiments, edge bracket 722 may have a length sized to the width of opening 410, which assists in securely affixing or holding load distribution structure 700 in place on the raised floor tile and within the opening in the raised floor tile.

In one or more implementations, fasteners (not shown) may, for instance, thread through fastener openings 730 in edging bracket 720 into frame load distributor 710 to secure the multiple pieces of the frame load distributor and the edging bracket together in fixed relation as illustrated in FIGS. 7A-7C. Those skilled in the art will note from the depicted configuration and the above description that the load distribution structure of FIGS. 7A-7F provides point load support for the frame load on the raised floor tile adjacent to a cutout in the raised floor tile, provides safety protection against rolling the electronics rack into the cutout in the raised floor tile and prevents cable damage by providing rounded corners to the edging bracket preventing damage to conduit or cabling passing through the cutout between the under floor plenum and the electronics rack. Further, the embodiment depicted is modular in design and can be readily adapted to different sized cutouts and to cutouts of different configuration, as required. Still further, the load distribution structure depicted in FIGS. 7A-7F solves the raised floor tile loading problem discussed herein without requiring any additions to the under floor structure.

Figure 8A:
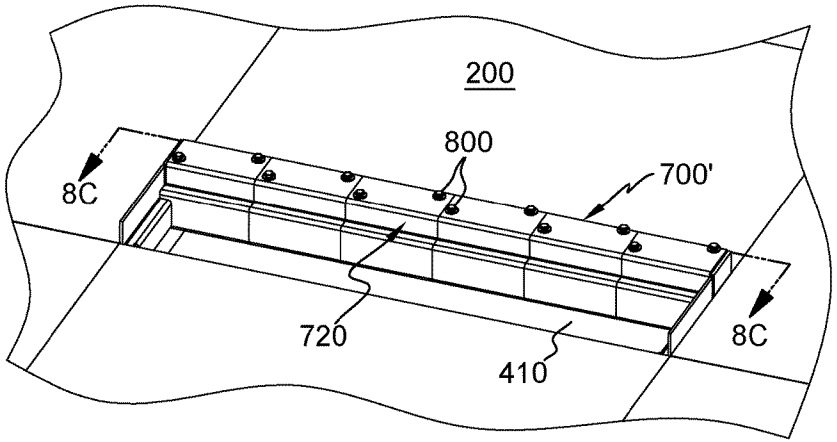
FIG. 8A depicts another embodiment of a load distribution structure, in accordance with one or more aspects of the present invention.
Figure 8B:
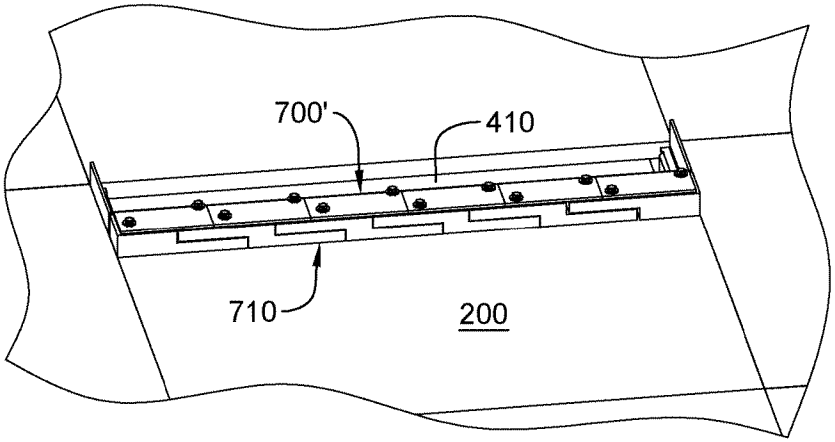
FIG. 8B depicts a back view of the load distribution structure embodiment of FIG. 8A, in accordance with one or more aspects of the present invention.
Figure 8C:
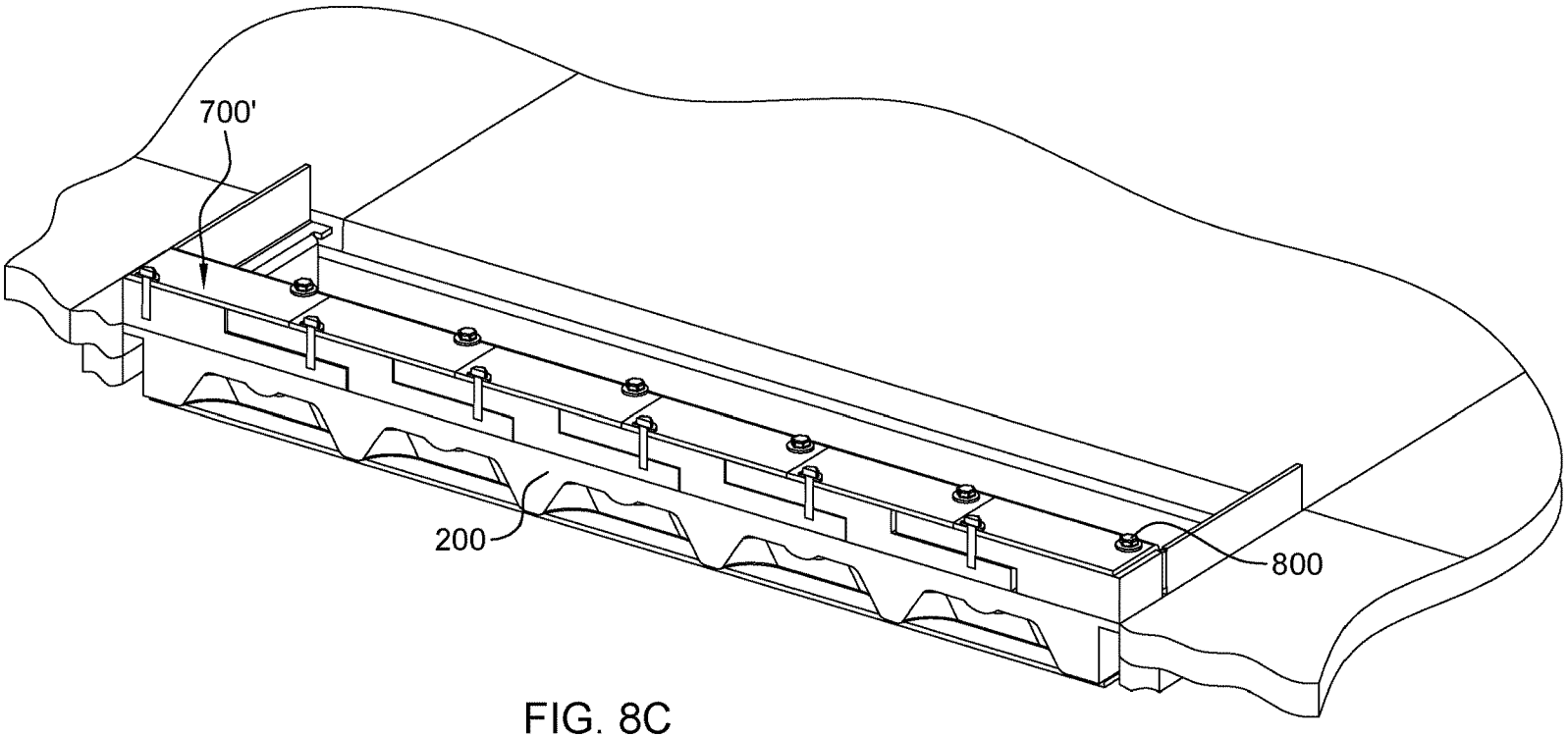
FIG. 8C is a cross-sectional elevational view of the load distribution structure of FIG. 8A, taken along line 8C-8C thereof, in accordance with one or more aspects of the present invention.

FIGS. 8A-8C depict an alternate embodiment of a load distribution structure 700'. This load distribution structure 700' embodiment is similar to load distribution structure 700 of FIGS. 7A-7F, with the exception that fasteners 800 are provided extending down through edging bracket 720 into frame load distributor 710 rather than extending in through the side. In particular, fasteners 800 are shown extending through the individual bracket sections 721 into the multiple interlocking bar sections 711, 712 to lock together the frame load distributor and the edging bracket in the desired position at opening 410 in raised floor tile 200. As illustrated in FIG. 8C, fasteners 800 do not extend into raised floor tile 200, in one or more implementations. This would ensure that integrity of the raised floor tile is not negatively affected by the fasteners of the load distribution structure.

Figure 9:
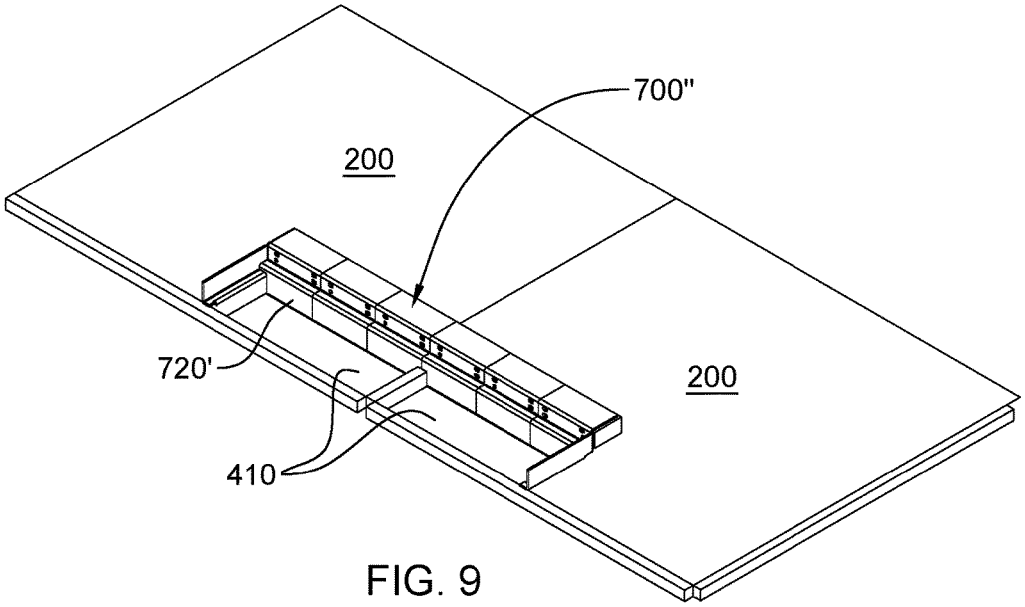
FIG. 9 depicts another embodiment of a load distribution structure for two adjacent raised floor tiles with a multi-tile cutout such as depicted in FIG. 6D, in accordance with one or more aspects of the present invention.

FIG. 9 depicts one embodiment of a load distribution structure 700" similar to that described above in connection with FIGS. 7A-7F, with the exception that in this embodiment, opening 410 spans multiple adjacent tiles 200. As shown, in this configuration, load distribution structure 700" may be substantially identical to that described above, with the exception that one or more bracket sections 721 may be partially cut within opening 410 to accommodate, for instance, a support bar or floor stringer, such as those described above.

Figure 10:
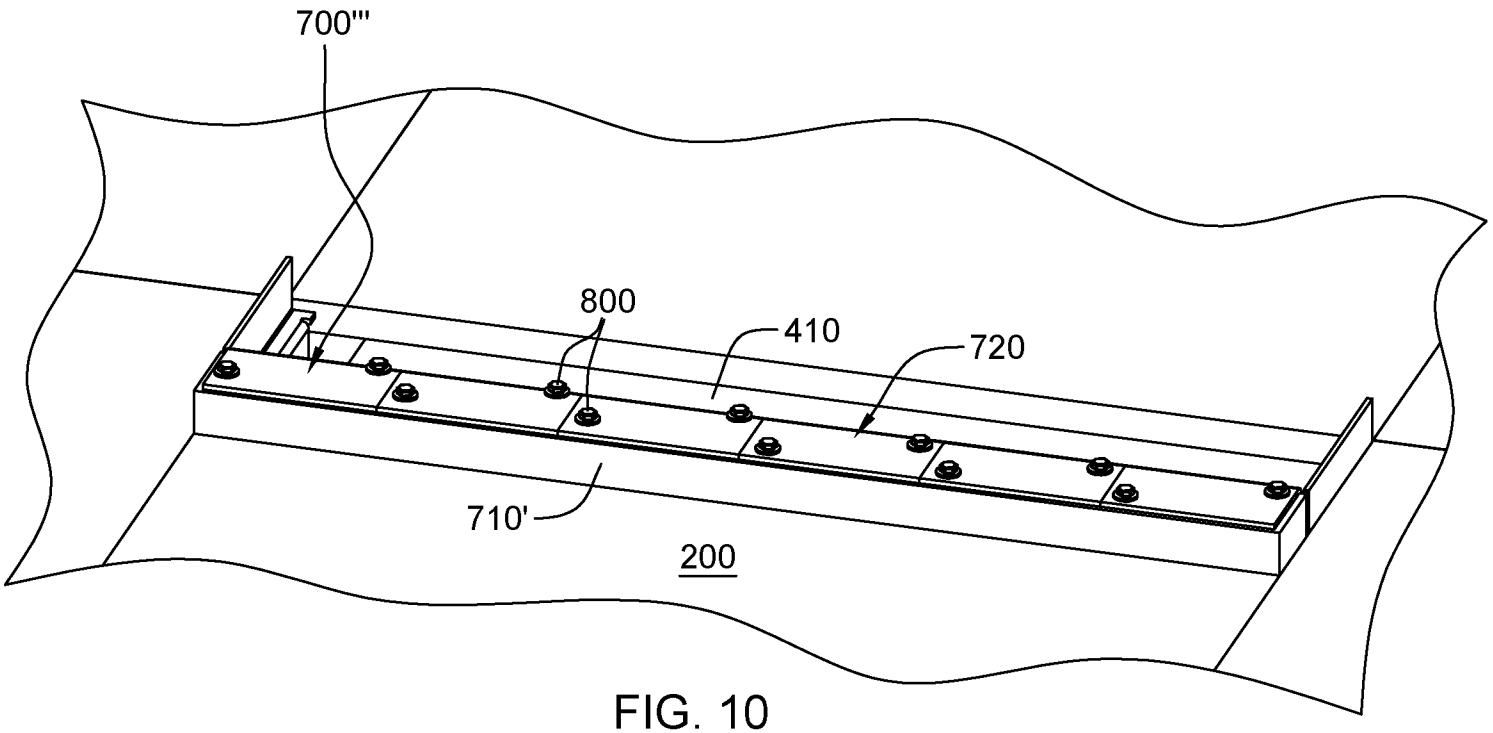
FIG. 10 illustrates a further embodiment of a load distribution structure for a raised floor tile, in accordance with one or more aspects of the present invention.

As noted, single-piece implementations of the frame load distributor and/or edging bracket may also be employed, if desired. In FIG. 10, a single-piece frame load distributor 710' is provided sized to the length of opening 410. Otherwise, load distribution structure 700'" is similar to load distribution structure 700' of FIGS. 8A-8C.

Figure 11A:
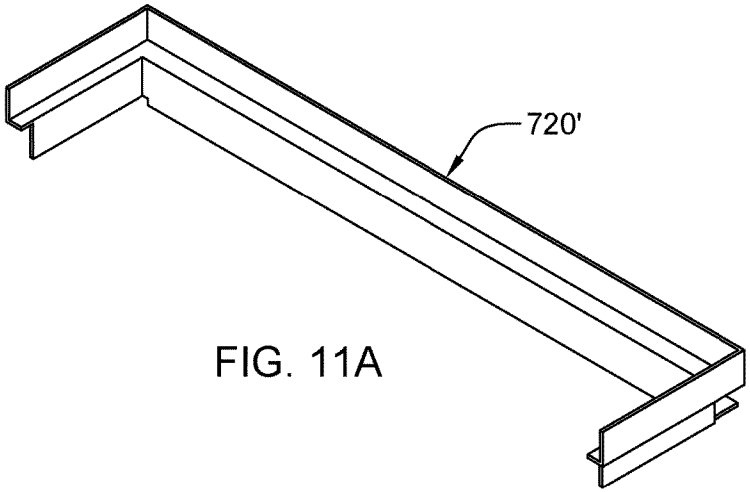
FIGS. 11A & 11B depict a further embodiment of an edging bracket for a load distribution structure for a raised floor tile, in accordance with one or more aspects of the present invention.
Figure 11B:
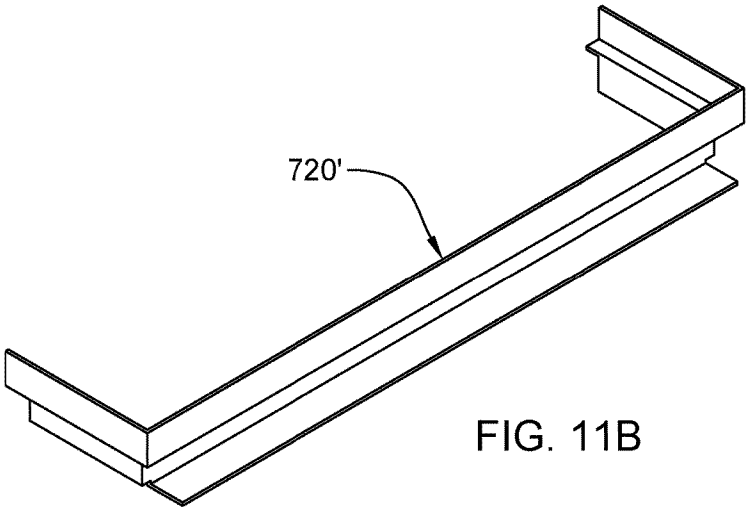

In FIGS. 11A & 11B, a single-piece edging bracket 720' configuration is depicted for use with the cutout in raised floor structure of, for instance, FIGS. 7A & 7B.

Note that in the cutout examples depicted in FIGS. 7A-8C & 10, the opening extends for the width of the raised floor tile. Those skilled in the art will understand, however, that the structures presented herein are readily applicable to other cutout configurations, such as described above in connection with FIGS. 6B-6D, as well as others.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprise" (and any form of comprise, such as "comprises" and "comprising"), "have" (and any form of have, such as "has" and "having"), "include" (and any form of include, such as "includes" and "including"), and "contain" (and any form contain, such as "contains" and "containing") are open-ended linking verbs. As a result, a method or device that "comprises", "has", "includes" or "contains" one or more steps or elements possesses those one or more steps or elements, but is not limited to possessing only those one or more steps or elements. Likewise, a step of a method or an element of a device that "comprises", "has", "includes" or "contains" one or more features possesses those one or more features, but is not limited to possessing only those one or more features. Furthermore, a device or structure that is configured in a certain way is configured in at least that way, but may also be configured in ways that are not listed.

The corresponding structures, materials, acts, and equivalents of all means or step plus function elements in the claims below, if any, are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of one or more aspects of the invention and the practical application, and to enable others of ordinary skill in the art to understand one or more aspects of the invention for various embodiments with various modifications as are suited to the particular use contemplated.

What is claimed is:

1. An apparatus comprising:

a load distribution structure for a floor tile to facilitate distributing a frame load on the floor tile, the load distribution structure comprising:

a frame load distributor to reside on the floor tile adjacent to an opening in the floor tile, the frame load distributor to distribute, at least in part, the frame load on the floor tile;

an edging bracket coupled to the frame load distributor to, at least in part, hold the frame load distributor in fixed position on the floor tile, the edging bracket extending, at least in part, into the opening in the floor tile to in part secure the frame load distributor in fixed position relative to the opening in the floor tile;

wherein the opening in the floor tile is a cutout of the floor tile, and the edging bracket further extends into the cutout, covering an upper edge of the floor tile at the cutout to protect conduit passing through the cutout; and wherein the edging bracket further wraps over the frame load distributor and holds the frame load distributor on the floor tile at a set, spaced distance from an edge of the cutout in the floor tile.

2. A data center comprising:

a floor structure comprising multiple floor tiles, a floor tile of the multiple floor tiles comprising an opening for passing conduit through the floor tile;

a frame disposed on the floor structure, including on the floor tile comprising the opening; and a load distribution structure disposed on the floor tile to facilitate distributing a frame load on the floor tile, the load distribution structure comprising:

a frame load distributor disposed on the floor tile adjacent to the opening, the frame load distributor distributing, at least in part, the load of the frame on the floor tile; and an edging bracket coupled to the frame load distributor to, in part, hold the frame load distributor in fixed position on the floor tile, the edging bracket extending, at least in part, into the opening in the floor tile to in part secure the frame load distributor in fixed position relative to the opening in the floor tile.

3. The data center of claim 2, wherein the opening in the floor tile is a cutout of the floor tile, and the edging bracket further extends into the cutout, covering an upper edge of the floor tile at the cutout to protect conduit, passing through the cutout.

4. The data center of claim 3, wherein the edging bracket further wraps over the frame load distributor and holds the frame load distributor on the floor tile at a set, spaced distance from an edge of the cutout in the floor tile.

5. The data center of claim 3, wherein the edging bracket further extends into the cutout and includes a lower flange extending around a lower edge of the floor tile at the cutout, and overlying and engaging, at least in part, a lower surface of the floor tile, the lower flange engaging the lower surface of the floor tile facilitating the load distribution structure in providing further structural support to the floor tile.

6. The data center of claim 3, wherein the frame load distributor comprises multiple interlocking bar sections, and the load distribution structure further includes multiple fasteners securing the edging bracket to the frame load distributor, the multiple fasteners also securing together the multiple interlocking bar sections.

7. The data center of claim 6, wherein the multiple interlocking bar sections include at least one z-shaped interlocking bar section.

8. The data center of claim 3, wherein the edging bracket comprises a bracket assembly including multiple preconfigured bracket sections disposed, at least in part, side-by-side, and secured to the frame load distributor by multiple fasteners.

9. The data center of claim 8, wherein the frame load distributor comprises multiple interlocking bar sections, the multiple fasteners further facilitating securing together the multiple interlocking bar sections of the frame load distributor.

10. The data center of claim 9, wherein the multiple interlocking bar sections include at least one z-shaped interlocking bar section.

11. A method of facilitating supporting a frame on a floor structure of a data center, the method comprising:

providing a load distribution structure for at least one floor tile of the floor structure, the load distribution structure to facilitate supporting a frame load on the at least one floor tile, the providing of the load distribution structure including:

providing a frame load distributor to reside on the at least one floor tile adjacent to the opening in the at least one floor tile, the frame load distributor to distribute, at least in part, the frame load on the at least one floor tile;

providing an edging bracket coupled to the frame load distributor to, at least in part, hold the frame load distributor in fixed position on the floor tile, the edging bracket extending, at least in part, into the opening in the floor tile to in part secure the frame load distributor in fixed position relative to the opening in the floor tile;

wherein the opening in the floor tile is a cutout of the floor tile, and the edging bracket further extends into the cutout, covering an upper edge of the floor tile at the cutout to protect conduit passing through the cutout; and wherein the edging bracket further wraps over the frame load distributor and holds the frame load distributor on the floor tile at a set, spaced distance from an edge of the cutout in the floor tile.

* * * * *